United States Patent [19]

Goda

[11] Patent Number: 4,478,581

[45] Date of Patent: Oct. 23, 1984

[54] METHOD AND APPARATUS FOR SHOOTING SIMULATION OF BALLISTIC AMMUNITION WITH MOVABLE TARGETS

[75] Inventor: Wilfried Goda, Hamburg, Fed. Rep. of Germany

[73] Assignee: Precitronic Gesellschaft fur Feinmechanik und Electronics mbH, Hamburg, Fed. Rep. of Germany

[21] Appl. No.: 364,230

[22] Filed: Apr. 1, 1982

[30] Foreign Application Priority Data

Apr. 7, 1981 [DE] Fed. Rep. of Germany ..... 3114000

[51] Int. Cl.[3] ..... G09B 9/00

[52] U.S. Cl. ..... 434/22; 273/312

[58] Field of Search ..... 434/16–22; 273/310–312; 358/126

[56] References Cited

U.S. PATENT DOCUMENTS

| | | | |
|---|---|---|---|
| 3,877,157 | 4/1975 | Ashford et al. | 434/22 |
| 3,907,433 | 9/1975 | Nault | 434/22 |
| 3,927,480 | 12/1975 | Robertsson | 434/22 |
| 3,965,582 | 6/1976 | Von Bennigsen | 434/20 |
| 4,053,929 | 10/1977 | Collins et al. | 358/126 |
| 4,189,747 | 2/1980 | Funari | 358/126 |
| 4,218,834 | 8/1980 | Robertsson | 434/21 |
| 4,246,705 | 1/1981 | Lee | 434/22 |
| 4,253,249 | 3/1981 | Ashford et al. | 434/22 |
| 4,315,689 | 2/1982 | Goda | 434/22 |
| 4,342,556 | 8/1982 | Hasse | 434/21 |

*Primary Examiner*—Richard C. Pinkham
*Assistant Examiner*—Leo P. Picard
*Attorney, Agent, or Firm*—Arnold, White & Durkee

[57] ABSTRACT

A shooting simulation and training method for ballistic ammunition and movable targets. Before firing the shot, a continuously repeated measurement of the target by laser measurement pulses transmitted at the weapons side is performed. A determination of the target distance and target deviation from a reference line, and storage of data derived therefrom is then performed. At the time of firing the shot, a transmission of the stored data by coded laser signals to the target is accomplished, followed by conclusion of scanning of the target. After firing the shot and during the simulated projectile flight time, measurement of the actual movement of the target relative to the receiving direction of the laser signals is determined. A score is determined by comparing the transmitted data with the target position at the end of the projectile flight time.

22 Claims, 7 Drawing Figures

FIG. 1
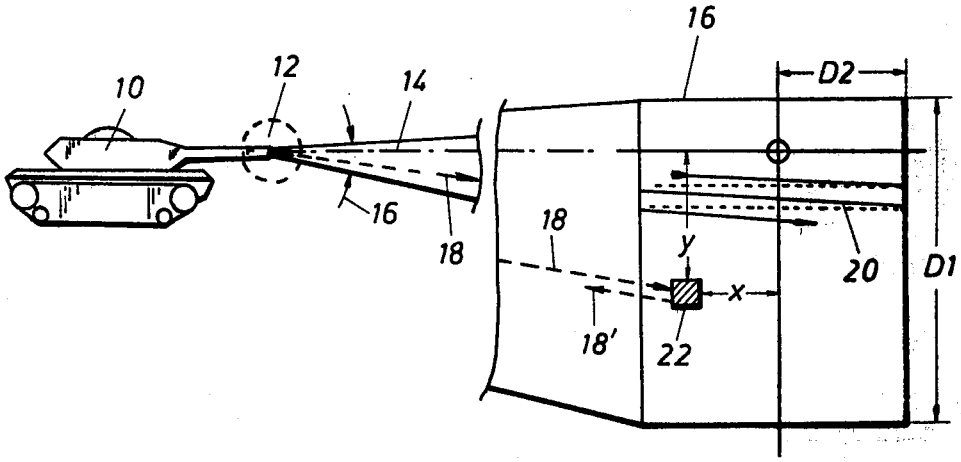
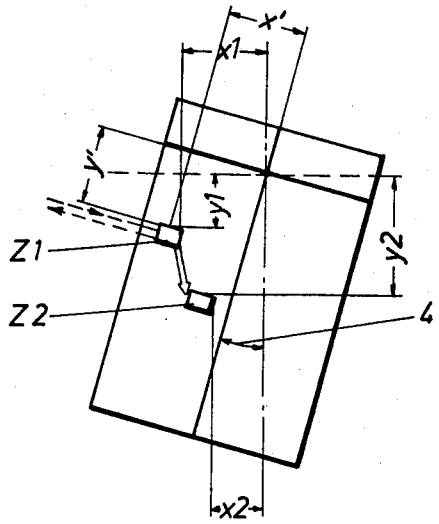
FIG. 3

FIG. 4
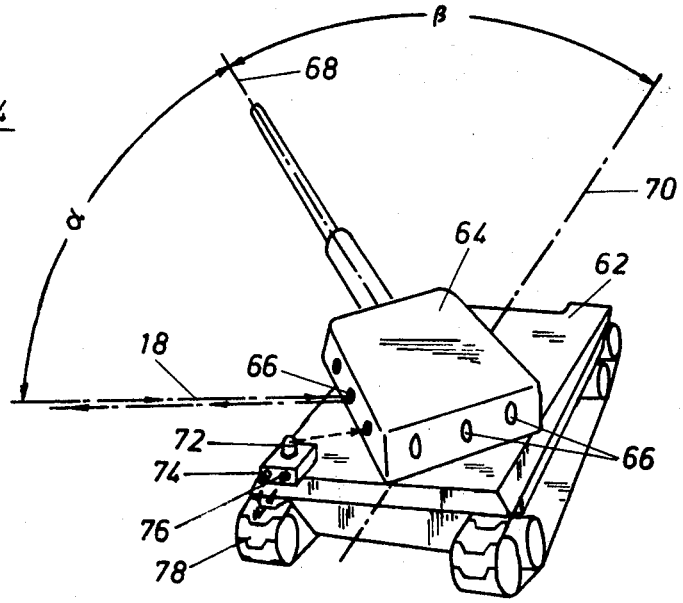
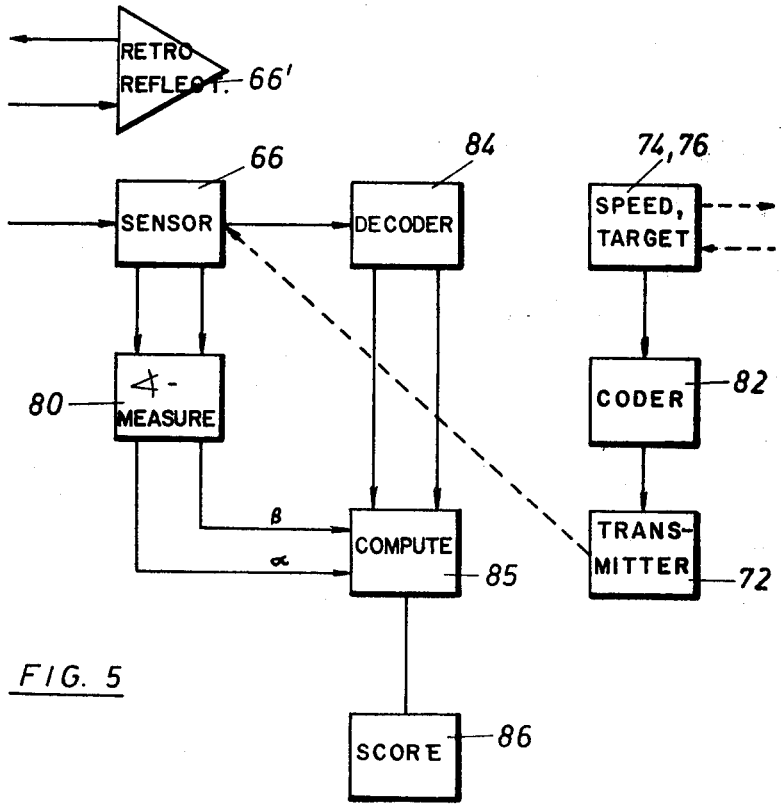
FIG. 5

METHOD AND APPARATUS FOR SHOOTING SIMULATION OF BALLISTIC AMMUNITION WITH MOVABLE TARGETS

BACKGROUND OF THE INVENTION

This invention relates to a method and apparatus for shooting simulation of ballistic ammunition where the targets are movable. More particularly, the invention relates to a shooting simulator where laser pulses are transmitted from a weapon within a solid angle relative to a reference line aligned with the sighting axis of the weapon. The laser pulses are reflected by the target. The target distance and its angle deviation from the reference line at the time of the shot are determined from the travel time of the reflected laser pulses and their position in the solid angle. The change in the position of the target during the projectile flight time, which corresponds to the target distance, is measured and compared with the measured angle deviation, and a score is registered depending on the results of this comparison. This invention also relates to an apparatus for carrying out this process.

In shooting with ballistic ammunition (in contrast with remote controlled ammunition), it is not only necessary to sight the target properly, but it is also important to set the angle of elevation between the axis of the weapon and the sighting line. The angle of elevation takes into account the curved projectile flight path on the basis of measured and estimated data regarding the target distance, type of ammunition, etc. When firing at moving targets, it is also necessary to take into account the projected change in position of the target during the projectile flight time. This change is in the form of the lead angle. The shot misses the target if the target is not sighted properly at the moment of firing, or if the angle of elevation or the lead angle is incorrect.

When shooting is simulated by means of laser beams which propagate linearly, then in the simplest form, control of the proper sighting of the target with laser beams transmitted along the sighting line is all that is necessary. However, for a correct ballistic evaluation of the simulated shot, the angle of elevation and lead angle relative to the sighting line must also be taken into account. In accordance with U.S. Pat. No. 3,257,741, a comparator device may be provided for this purpose to compare the actual target distance measured by the laser pulse time with the target distance estimated and set by the weapon operator.

With another system that is known from French Pat. No. 1,580,909, the laser beam is deflected with respect to the axis of the weapon by an angle which corresponds to the theoretical angle of elevation, so that the laser beam can hit the sighted target only if the actual angle of elevation corresponds to the theoretical angle of elevation. It is also known from the same publication that the laser beam can pass through a scanning pattern with respect to the sighting line so that the angle deviation of the target with respect to the sighting line can be quantified on the basis of the location in the scanning pattern of that portion of the laser radiation which is received at the target. Thus, the angle deviation can also be related to the angle of elevation and the lead angle.

All these known systems utilize additional data regarding weapon settings which must be input into the shooting simulation equipment by means of input and interface stations by the weapon system in analyzing a simulated shot. The shooting simulation and evaluation equipment must therefore be adapted to a given weapon system with regard to the data to be transferred and the interfaces required for this purpose. Thus, it cannot be used universally for any other weapon systems. With the known equipments, it is impossible to accurately take into account the lead with movable targets or to take into account a tilted weapon position relative to the vertical.

This invention is therefore based on the above-mentioned process which is known from German patent application No. 2,262,605, (corresponding to U.S. Pat. No. 3,927,480) which has the advantage that all data which reproduce the alignment of the weapon at the time when the shot is fired, relative to the position assumed by the target at the end of the projectile flight time, are measured and determined autonomously by the shooting simulation equipment so that no data transfer from the weapon system is necessary and no interfaces are required. Equipment operated according to this principle can therefore be designed for universal use with weapons systems of any type.

With this known process, the change in position executed by the target during the projectile flight time is measured by the fact that another laser beam is transmitted into the solid angle at the end of the projectile flight time, and the distance and deviation of the target are determined again. However, this is possible only when the transmission equipment and the solid angle reference line for the first and second laser pulses are exactly the same. Therefore, it is either necessary for the weapon to be kept motionless during the simulated projectile flight time or else the laser transmitter must be disconnected from the weapon after firing the shot and kept directionally constant, for example, by a gyroscope-stabilized platform. This, of course, is more expensive and leads to an unrealistic shooting operation, because under practical conditions, a weapon is moved immediately after firing a shot in order to change locations or to aim at another target. This method cannot be used at all in cases when the weapon must be moved under cover during the projectile flight time, for example, or when it must be shifted by a large amount.

Another disadvantage of the known process is that each laser pulse must cover a large solid angle simultaneously, so it must have a high intensity and therefore entails the danger of eye damage at a short distance from the weapon. Furthermore, the target deviation is determined by means of a direction-sensitive receiver which responds to the reflection pulses, so the accuracy of the measurement is limited.

SUMMARY OF THE INVENTION

This invention is based on the task of improving a process of the type mentioned initially so that the relationship between the spatial alignment of the axis of the weapon at the time of the shot and the actual target position at the end of the simulated projectile flight time can be determined with the greatest accuracy possible with the available measurement technology without the necessity of keeping the weapon or the laser transmitter aimed at the target during the projectile flight time and without the necessity of interfaces for data transfer from the weapons system.

This task is solved according to this invention by the fact that the value for target distance and target deviation and/or values derived therefrom regarding the projectile flight time and angle of elevation and lead angle at the time when the shot is fired, are transmitted to the target by coding the laser pulses, and then terminating the laser beam communication betweeh weapon and target. Furthermore, the direction of incidence of the laser pulses and the change in position of the target relative to this direction during the projectile flight time are determined with equipment provided at the target and then compared with the values transmitted by the laser pulses.

The main advantage achieved in this way is that from the moment the shot is fired, it is no longer necessary to maintain a directional reference between weapon and weapon, so the target can be moved immediately and/or aimed at a new target. With respect to measurement of all data that are important for the weapon-target reference, the shooting simulation system is autonomous and does not use any interfaces to the weapon system.

In another embodiment of this invention, the transmission of the laser pulses and determination of the target distance and target deviation, or the values derived therefrom, are repeated continously within a period of time preceding the firing of the shot, and these values are stored continously, and at the time when the shot is fired, the last values stored are transmitted to the target.

This yields the important advantage that sufficient time is available for determination of the data required for the target distance and target deviation and/or for obtaining the data derived therefrom, which is important for the accuracy of the respective measurements. In particular, it is then possible in an advantageous way to transmit the laser pulses within the solid angle in a continously repeated scanning pattern and to determine the target deviation from the position of the reflected laser pulses in the scanning pattern.

It is essentially known that the deviation of a target from a sighting line can be determined by means of a scanning pattern covered by a laser beam, but the divergence in the scanning pattern corresponds only to the sighting errors that occur in practice. In the method according to this invention, the divergence in the scanning pattern must be considerably greater, namely at least as great as the maximum angle of elevation and lead angle of the weapon that can occur in practice. A brief period of time, limited essentially to the time it takes the shot to be fired, would not be sufficient to cover such a large scanning pattern. This drawback is overcome by the feature of the method according to this invention whereby a longer period of time which precedes the actual shot is utilized for continuous measurement.

According to another aspect of the method according to this invention, the tilt of the weapon with respect to the vertical is measured continuously, and the values determined for the target deviation are converted to values of the effective angle of elevation and lead angle relative to the vertical. These values are stored and transmitted to the target at the time of the shot. In this way, it is possible to take into account any deviation from the vertical in the position of the weapon (e.g., of a tank) and of the laser transmitter connected to it without the need for special weapon-side equipment, such as a gyroscope-stabilized sighting device, etc., or interfaces between such equipment and the shooting simulation system.

This invention also concerns an apparatus for carrying out the process according to the invention. The apparatus includes a laser transmitter connected to the weapon for transmitting laser pulses in a solid angle, target-side retroreflectors, a weapon-side receiver for reflected laser pulses with plotting devices for measuring their transit time and direction with respect to the axis of the weapon, a coding device for imparting a code which reproduces these data or data derived therefrom to the laser pulses, and one or more target-side sensors with plotting equipment connected to them for comparing the coded data with target position data available at the end of a projectile flight time which corresponds to the target distance and for appropriate control of a hit indicator.

In accordance with the present invention, an apparatus for simulating shooting with ballistic ammunition from a weapon having a sighting axis onto a moving target using laser pulses transmitted from the laser transmitter mounted on the weapon in alignment with the sighting axis of the weapon. The target includes retroreflectors for reflecting the laser pulses back to laser receivers on the weapon. The apparatus includes a control means in the transmitter for controlling the transmitted pulses to repeatedly scan through a scanning pattern which defines a solid angle, the solid angle includes a reference line therethrough corresponding to the sight axis of the weapon.

Also included in the weapon is a weapon-side plotting means responsive to the laser receiver for determining target position related data including the target distance from the transit time of the laser pulses from transmitter to receiver, and the off-aim position of the target relative to the reference line from the direction of the reflected laser pulses from the target relative to the sighting axis of the weapon. A first memory is included in said weapon-side plotting means for storing the last valid values for the target position related data.

A coding means on the weapon-side is included for controlling the control means at the time of each shot simulation to superimpose on the laser pulses a code representative of the last values of the target position related data stored in the first memory. A measurement means on the target-side having sensors for determining the direction of incidence of the laser pulses received at the target is also included. This measurement means determines the travel speed of the target and the direction of travel relative to the measured direction of incidence.

A target-side plotting means responsive to the measurement means is provided for determining actual target position related data at the end of the projectile flight time on the basis of the travel speed relative to the direction of incidence. The target-side plotting means includes a comparison means for comparing the transmitted target position related data to the actual target position related data and for indicating a hit if they correspond.

Other advantageous features of the apparatus according to this invention are characterized in the dependent apparatus claims appended hereto.

BRIEF DESCRIPTION OF THE DRAWINGS

The preferred embodiment of this invention is illustrated and described below in greater detail with reference to the figures in which:

FIG. 1 shows a diagram of the relationships between weapon and target in the method according to this invention;

FIG. 3 illustrates how the tilt of the weapon and the change in position of the target are taken into account;

FIG. 4 shows in diagram form an armored vehicle with the target-side equipment used in the method according to this invention;

FIG. 5 shows a schematic wiring diagram of the equipment provided at the target;

DETAILED DESCRIPTION OF THE PREFERRED EMBODIMENT

Figure 2:
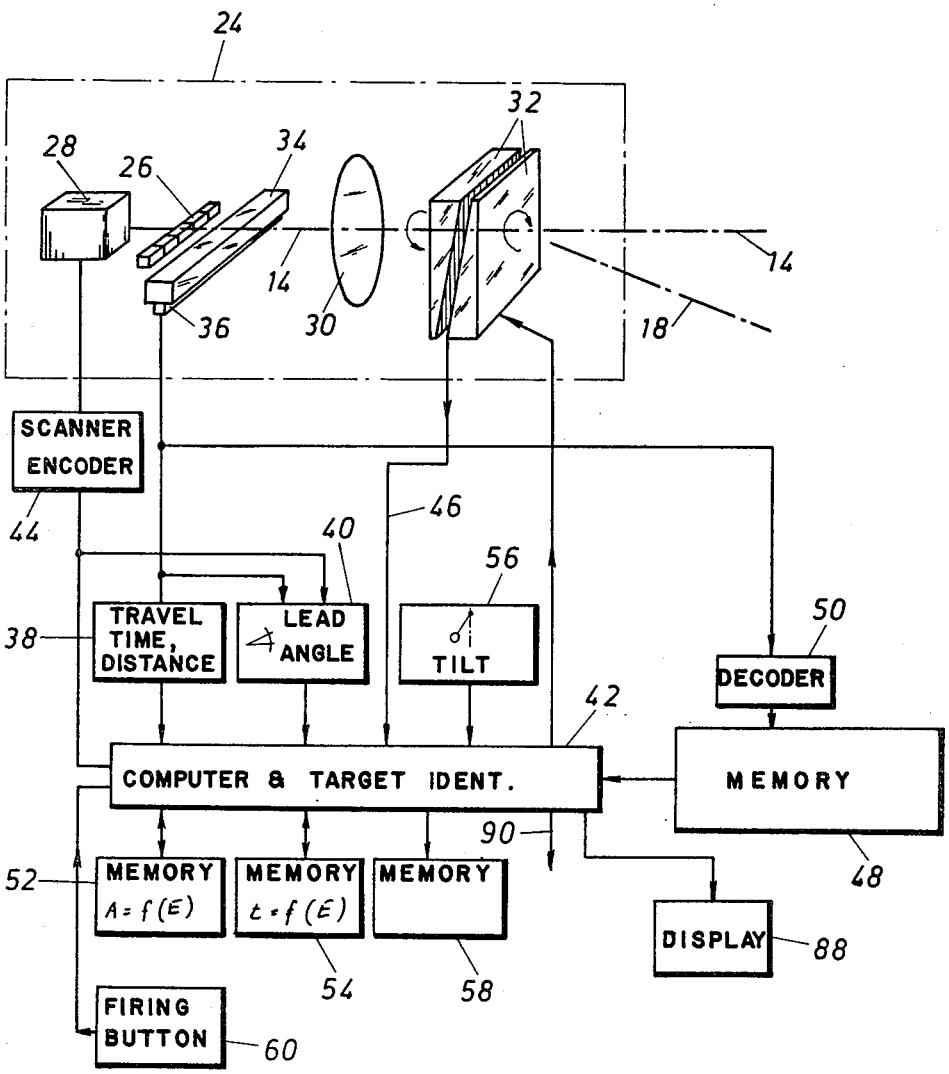
FIG. 2 shows a schematic wiring diagram of the equipment provided at the weapon-side.

Referring to the figures and first to FIG. 1, a diagram of an armored vehicle 10 with a gun barrel at 12 which contains a device (to be described below) is shown. The device essentially consists of a laser transmitter with a deflector device, a receiver and plotting equipment. Within a solid angle sector 16 relative to the axis of the bore 14 of the weapon 12, which has a certain divergence vertically and horizontally, a pulse-coded laser beam 18 is transmitted and deflected in such a way that it regularly passes over the solid angle sector 16 shown at the right in FIG. 1 in the form of scanning pattern 20, e.g., in the form of horizontal lines. The reference line for the scanning pattern is the extension of the axis of bore 14, and the divergence of the solid angle sector 16 has a vertical amount D1 which is at least as great as the largest angle of elevation or super elevation of the weapon which can occur under practical conditions, while in the horizontal direction the solid angle sector 16 must have a divergence D2 toward each side which is at least as great as the maximum lead angle of the weapon which can occur under practical conditions in shooting at moving targets.

When laser beam 18, passing through the scanning pattern 20, encounters a target 22 which is within the solid angle sector 16 and is provided with equipment (to be described below) which includes at least one retroreflector, then laser beam 18 is reflected back on itself and the returning laser beam 18' reaches the receiver provided at the weapon-side at 12. The target distance can be determined from the transit time of the reflected laser light, and the angle deviation x and y in lateral direction and in altitude from the horizontal and vertical reference lines drawn by extending the axis of the weapon 12 can be determined from the relationship between the target distance and scanning pattern 20.

FIG. 2 shows at least the parts encompassed by the dash-dot line 24 in the barrel of the weapon at 12. The laser transmitter consists of several (e.g., 5) laser transmission elements, especially cyclically switched laser transmitting diodes 26 which can be regulated by control device 28, a focusing lens system 30, and a pair of counter-rotating wedge prisms 32 rotating in opposite directions about optical sighting axis 14 (which coincides with the axis of bore 14 according to FIG. 1) to produce the vertical deflection of the laser beam. The entire system produces laser beam 18 which is deflected horizontally by sequential switching of laser diodes 26, and is deflected vertically by the rotating wedge prisms 32 so that it passes through the deflection pattern 20 shown in FIG. 1 within the solid angle sector 16. Control unit 28 not only permits sequential switching of laser diodes 26 in accordance with the scanning pattern, but also a pulse-coded switching of the individual laser diodes 26 for the purpose of superimposing information on laser beam 18.

In the path of the beam of lens system 30 there is also a beam splitter 34 with which reflected light from a target 22 (FIG. 1) can be deflected to a receiver element 36.

Receiver 36 is connected to a device 38 for determining the transit time of the laser light reflected by the target and for determining the target distance. In addition, receiver 36 is also connected to a device 40 for determining the horizontal angle deviation x of the target on the basis of the assignment of the reflected laser light to the respective laser diode 26. These two devices 38 and 40 provide data input into a computer 42 which has a control function that controls the control unit 28 via a scanner-coder 44 to regulate the time at which laser diodes 26 are switched and, in proper synchronization, to control the drive unit for wedge prisms 32. The computer also receives constant reports via 46 regarding the instantaneous position of the wedge prisms 32 and thus the vertical reference of the scanning pattern. From this information, computer 42 can determine the vertical angle deviation y of target 22 with respect to the axis of bore 14.

Computer 42 is connected to a memory 48 for storing data on the type of ammunition used, the ammunition supply and other information on which each shooting operation is based. It is also advantageous for input into memory 48 to be designed in such a way that the contents of the memory 48 cannot be altered arbitrarily by each weapon operator to be trained. For example, this can be done by providing the instructor with a laser transmission unit with which he transmits in a special way coded laser pulses which relay the proper information to memory 48 via receiver 36 and decoder 50. In other memory units 52 and 54, which are also connected to computer 42 (and which of course may also be combined in one unit with memory 48), tabular data are stored so that for a given measured distance E, it is possible to determine the angle of elevation or superelevation A of the weapon that is needed for this target distance and the projectile flight time for this target distance. The computer can calculate the projectile flight time and the ideal angle of elevation by calling up these data from memory 52 and 54 and the data on the type of ammunition from memory 48.

The angle deviation x and y of the target that can be measured with the equipment described so far indicates the actual vertical angle of elevation and horizontal lead angle only if weapon 10 is aligned exactly with the vertical. If weapon 10 is tilted, as in an uneven terrain, for example, then scanning pattern 20 which is traversed in solid angle 16 is also tilted with respect to the vertical, as indicated in FIG. 3. Computer 42 is connected to a tilt measurement device 56 which measures the angle of tilt of the weapon with respect to the vertical (see FIG. 4). Such tilt measurement devices which operate with a gravity pendulum, for example, or with a gyroscope-stabilized reference element, are already known and are commercially available, so they need not be described here in detail.

When the angle of tilt $\alpha$ is taken into account, computer 42 can convert the angle deviation x' and y' according to FIG. 3, relative to the scanning pattern 20, into the actual horizontal and vertical angle deviations x and y which represent the angle of elevation and lead angle that are actually relevant for the projectile. Computer 42 determines the difference between the actual angle of elevation and the theoretical angle of elevation which is taken from the memory 42 and corresponds to the target distance. The data collected continuously by computer 42 are stored or updated continously in another memory or memory part 45. A firing button 60 for the simulated shot is connected to computer 42. When it is activated, the values stored last in memory 58 are sent by computer 42 via scanner-coder 44 to control unit 28, so they are transmitted to the target in the form of a pulse code superimposed on laser beam 18.

The weapon-side equipment described above would be suitable only for shooting simulation and determination of deviation with stationary targets. In training military personnel to shoot at moving targets, the change in position of the target which occurs during the projectile flight time must also be taken into account. This is done according to this invention exclusively with equipment provided at the target side.

FIG. 4 shows an armored vehicle 62 equipped for the method according to this invention with a rotating turret 64 which has a number of sensors 66 around its periphery. These sensors are at the same time designed in the form of retroreflectors, so that they reflect the oncoming leaser beam 18 back into its angle of incidence. Each sensor 66 is designed with equipment to determine the angle of incidence $\alpha$ of the laser beam 18 with respect to the median line 68 of turret 64. This can be done with azimuth-sensitive receivers of any known design. The direction of incidence of laser beam 18 must be determined not with respect to turret 64, but with respect to the direction of travel 70 of the target vehicle 62. To this end, the angle position of turret 64 relative to the undercarriage must be determined.

In order to accomplish this without equipment with interfaces between turrets and undercarriage to be installed on the armored vehicle, a reference transmitter 72 is provided on the undercarriage and transmits optical radiation, preferably laser radiation. This can also be received by each of the sensors 66 on the turret 64, and the direction of incidence with respect to the median axis of the turret 68 can also be determined. These data can be used to calculate the angle $\beta$ between the median line 68 of the turret and the longitudinal axis (direction of travel) 72 of the target vehicle 62. This yields the total angle $\alpha+\beta$ between the direction of incidence of the laser beam 18 coming from the weapon and the direction of travel 70 of the target vehicle 62.

A device is also provided for determing the travel speed of the target vehicle 62 which is also designed in such a way that it does not required any intervention in target vehicle 62, nor does it require any interfaces for the transmission of information to the turret 64. In the version shown here, the measurement equipment consists of a light source 74 for transmitting light, preferably laser light, to the chain 78 of the vehicle, and a sensor 76 for receiving the light reflected by the chain 78. Depending on the size and the rotational speed of the chain elements, the received light is modulated, and the travel speed can be determined from this modulation. The resulting value can be transmitted in a simple way to turret 64 and the plotting equipment provided there by means of pulse coding of the reference transmitter 72.

By integration of the vehicle velocity thus determined with respect to the projectile flight time of the simulated shot, relative to the line 18 connecting weapon and target, the change in position of the target from position z1 (see FIG. 3) when the shot is fired to position z2 at the end of the projectile flight time can be determined, which in turn yields the target deviation values x1 and y1 which must actually be taken into account in evaluating the shot and registering the hit.

The wiring diagram of the equipment provided at the target-side is shown in FIG. 5. Each sensor 66 is combined with a retroreflector 66' (especially in the form of a cubic prism). Sensor 66 is also provided with a device 80 for determining the angle of incidence of each beam received. Units 74 and 76 are provided to determine the travel speed of the targets which triggers transmitter 72 via coder 82. The transmitter is also the reference transmitter for determining the angle position $\beta$ of the turret 64 relative to the vehicle axis 70. The angle measurement equipment 80 therefore determines both the angle of incidence $\alpha$ relative to the turret of the laser beam coming from the weapon, as well as, the angle between the turret and the undercarriage. Sensor 66 is also connected to a decoder 84 which decodes the information regarding the projectile flight time, target deviation, type of ammunition, etc., which is transmitted from the weapon by pulse coding of the laser beam. This information is sent to a computer 85 which compares the point of impact of the simulated projectile, which is based on the actual angle of elevation and lead angle for the given target distance and type of ammunition with the target position at the end of the projectile flight time on the basis of the actual movement of the target, and when there is sufficient agreement, computer 85 registers a hit or score on display 86.

An important feature of this invention consists of the fact that with the equipment shown in FIG. 2, laser beam 18 is transmitted in the scanning pattern continuously for a certain period of time before each shot is fired. Then when the shot is fired, the last valid data on the projectile flight time, target deviation, etc., are transmitted to the target and the laser beam communication between weapon and target is terminated, so the weapon can readily be moved away, brought under cover or aimed at a new target during the projectile flight time, as would correspond to actual combat practice. All measurements and plotting which remain to be performed after firing the shot during the projectile flight time are performed exclusively at the target side.

Figure 6:
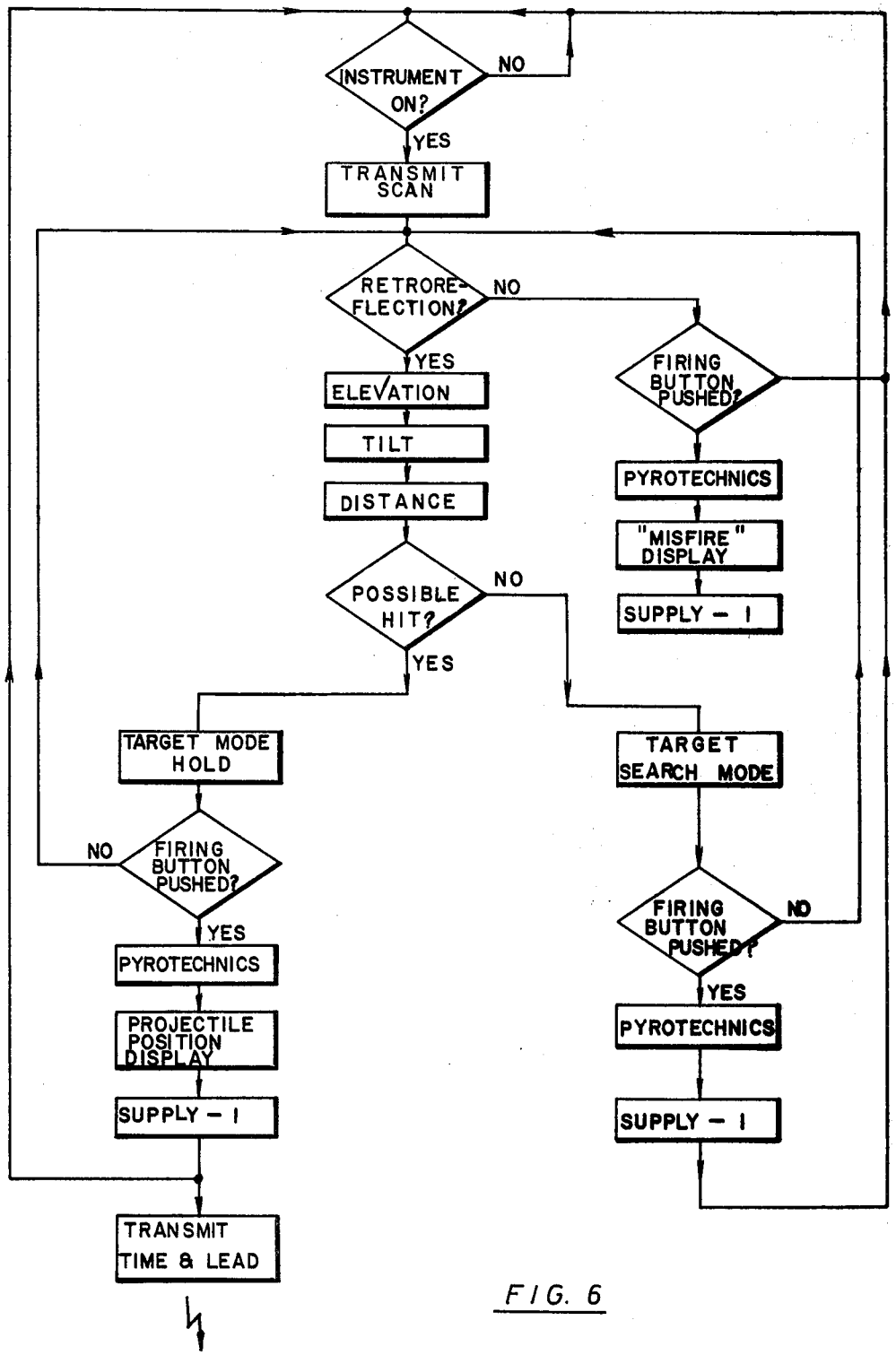
FIG. 6 shows a diagram of the function and program operations by the equipment on the weapon side.

The weapon-side equipment shown in FIG. 2 is preferably operated as illustrated in the functional schematic and logic diagram shown in FIG. 6. In operation of the instrument (instrument ON), the scanning pattern of the laser beam 18 is traversed in continuous repetition in solid angle sector 16 with an adequate divergence (e.g., 12 mrad horizontally and 60 mrad vertically). If retroreflection is picked up from a target, the respective angle of elevation, the tilt and the target distance are measured. The decision is made at the stage labeled "possible hit" as to whether a hit was in fact possible (with a stationary target). If this is the case (possible hit: yes), measurement of this target is repeated continously ("target contact mode hold"), and it is now possible to limit scanning pattern 20 in an advantageous way to a smaller region within the solid angle sector 16 in the vicinity of target 22. As long as the firing button is not activated, the measurement operation is repeated continuously. When the firing button has been activated, a pyrotechnic charge simulating the firing of a projectile can be ignited ("pyrotechnics"), the projectile supply in storage 48 is reduced by 1, and in particular, the last valid values regarding projectile flight time and target deviation are sent to the target, as indicated by the arrow. The position of the projectile impact point can also be indicated at the weapon side, e.g., on display 88 (FIG. 2), to allow a trainee to evaluate the shot.

As long as a target does not pick up any retroreflection in passing through the scanning pattern ("retroreflection: no"), the scanning operation is repeated in the entire solid angle sector 16. If in such a case the firing button is nevertheless activated (e.g., by accident), then of course the pyrothechnic charge is still ignited, the projectile supply is reduced by 1, and furthermore, there may also be a "misfire" display.

When the evaluation "possible hit?" indicates that a hit on the target is impossible at the moment, e.g., because of a distance which exceeds the projectile range, such scanning is continued in the entire solid angle sector 16, "target search mode." Again in this case, it can happen that the firing button is unintentionally activated, and again, there will follow a pyrothechnic display of the shot and the projectile supply will be reduced by 1.

Figure 7:
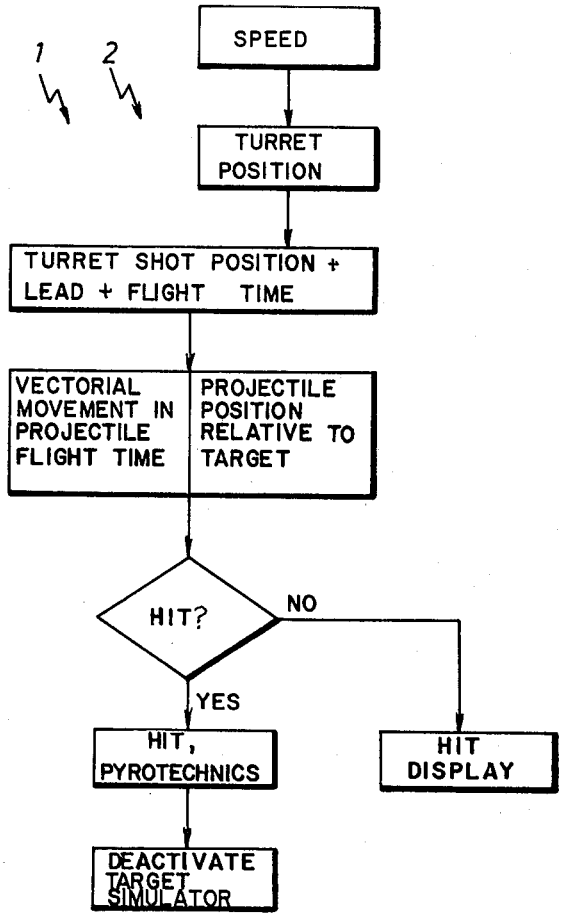
FIG. 7 shows a diagram of the function and program operations of the equipment at the target side.

FIG. 7 shows the functional schematic and logic diagram of the target-side equipment. Velocity and turret position are measured. Receipt of the data relative to the shot by the weapon is indicated with 1. Receipt of the data indicating travel speed by the reference transmitter 72 is indicated with 2. The location of the projectile impact point relative to the position of the target at the end of the projectile flight time is determined from the location of the projectile relative to the target at the time the shot is fired and from the vectorial movement of the target during the projectile flight time relative to the firing direction, and this information is used to make the decision regarding the "hit."

If there is sufficient agreement to indicate a hit, a pyrothechnic display of the effect of a projectile on impact is triggered at the target, and furthermore, the target-side equipment is deactivated, because the target has now been eliminated as a target to be fired at. If the shot is not evaluated as a hit, the target may still show a pyrothechnic display indicating that the target is under fire.

In describing the invention, reference has been made to a preferred embodiment. However, those skilled in the art and familiar with the disclosures of the invention may recognize additions, deletions, substitutions or other modifications which would fall within the purview of the invention as defined in the claims. For example, instead of simulating the travel speed of the target by means of optical scanning of a rotating chain, this may also be accomplished in other ways, e.g., by means of a device which analyzes the vibration spectrum of the vehicle and determines the travel speed on this basis, or by means of a device with an optical correlator which determines the travel speed relative to the environment.

The weapon-side equipment, which is shown as completely interface-free with the other weapons systems, such as the sighting mechanism, etc., may, if desired, have an output 90 which makes it possible to input the measured target distance into the weapons system where the target distance (of targets that are not then retroreflecting) is determined with a high-power laser in combat use. This makes it possible to operate the weapon for training purposes, as would be the case in combat using a high-power laser, without having to operate the high-power laser itself during training. This also avoids the risk of eye damage. The laser transmitter of the shooting simulation equipment can be so weak (because the targets are provided with retroreflectors, i.e., they are "cooperative") that the radiation intensity is below the eye damage limit.

What is claimed is:

1. A method of simulating shooting with ballistic ammunition from a weapon having a sighting axis onto a moving target using laser pulses, said weapon aimed acoording to a required elevation and lead angle relative to the target, the method comprising the steps of:

(a) determining at the weapon, prior to releasing a simulated shot, position related data of the target relative to the weapon, the position related data including at least the time-of-flight interval of a simulated projectile over the actual target distance and the elevation and lead angles of the wepon relative to the aotual target position;

(b) transmitting, at the moment of releasing a simulated shot, the position related data via coded laser pulses from the weapon to the target, determining at the target the direction of incidence of the laser pulses, and terminating laser pulse transmission from the weapon to the target;

(c) measuring at the target, during a time interval following the transmission of the laser pulses and corresponding to said time-of-flight interval of the simulated projectile, the movement of the target vectorially relative to the determined direction of incidence of the laser pulses, determining therefrom the final target position at the end of said time-of-flight interval, and comparing it with the transmitted position related data;

(d) controlling a hit indication responsive to the degree of correspondence between the final target position and a point of impact of the simulated shot determined from the transmitted position related data.

2. The method of claim 1 wherein the steps of determining position related data of the target comprises the steps of:

(a) emitting from the weapon, laser pulses which scan a solid angle having a reference line therethrough;

(b) reflecting the laser pulses from the target back to the weapon;

(c) determining from the reflected laser pulses, the target distance and the target off-aim from the sighting axis of the weapon, said sighting axis of the weapon being aligned with the reference line; and (d) determining from the target distanoe and off-aim position, the target position related data including the time-of-flight interval for the particular ammunition to be simulated and the actual elevation and lead angles of the weapon relative to the target.

3. The method of claims 1 or 2 further comprising the steps of:

(a) continuously repeating the step of determining the target position related data within a period of time prior to the firing of a shot simulation;

(b) storing the last determined position related data; and (c) transmitting to the target at the time of a shot simulation the most recently stored position related data.

4. The method of claim 2 wherein the step of determining the required elevation and lead angle of the weapon includes the steps of:

(a) continuously measuring the tilt of the sighting axis of the weapon with respect to the vertical;

(b) repeatedly determining from the target off-aim position the effective angle of elevation and lead angle relative to the vertical;

(c) storing the last determined effective angle of elevation and lead angle; and (d) transmitting to the target at the time of a shot simulation the most recently stored elevation and lead angles.

5. The method of claim 2 wherein the reference line of the solid angle is the sighting axis of the weapon, and wherein the divergence of the solid angle horizontally and vertically at least equal to the maximum values for the angle of elevation and the lead angle under practical conditions are within the solid angle divergence, with allowance for the tilt of the sighting axis.

6. The method of claims 2, 4 or 5 wherein the laser pulses are transmitted in a constantly repeated scanning pattern within the solid angle, the target off-aim determined from the position of the reflector laser pulses in the scanning pattern.

7. Apparatus for simulating shooting with ballistic ammunition from a weapon having a sighting axis onto a moving target using laser pulses transmitted from a weapon-side laser transmitter, the target including target-side retroreflectors for reflecting the laser pulses back to a weapon-side laser receiver, the apparatus comprising:

(a) a control means in said laser transmitter for controlling the transmitted pulses to repeatedly scan through a scanning pattern which defines a solid angle, the solid angle having a reference line therethrough corresponding to the sighting axis of the weapon;

(b) a weapon-side plotting means responsive to the weapon-side laser receiver for determining target position related data including the target distance from the transit time of the laser pulses from the transmitter back to the weapon-side receiver, and the off-aim position of the target relative to the reference line from the direction of incidence of the target reflected laser pulses relative to the sighting axis of the weapon, said means for determining the target distance and off-aim position including a first memory for storing the last determined values for the target position related data;

(c) a weapon-side coding means for controlling said control means at the time of each shot simulation to superimpose on the laser pulses a code representative of the last stored values for the target position related data, the target position related data including the time-of-flight for the projectile to reach the target and an elevation and lead angle which defines a predicted position for the target at the end of the flight time;

(d) a target-side measurement means including sensors for determining the direction of incidence of the transmitted laser pulses, for receiving.the coded position related data, and for determining the travel speed of the target and the direction of travel relative to the measured direction of incidence; and (e) a target-side plotting means responsive to said measurement means for determining actual target position related data at the end of the projectile flight time on the basis of the travel speed relative to the direction of incidence, said target-side plotting means including a comparison means for comparing the transmitted target position related data to the actual target position related data determined at the end of the flight time and for indicating a hit if they correspond.

8. The apparatus according to claim 7 wherein said control means of said laser transmitter is connected to the weapon-side plotting means in such a way that after identification of a laser pulse-reflecting target, said control means regulates the laser pulse transmission into a smaller scanning pattern that covers only the immediate vicinity of the identified target.

9. The apparatus according to claim 7 further including an instrument connected to the laser transmitter for measuring tilt of the sighting axis relative to the vertical, said weapon-side plotting means taking into account the location of the scanning pattern with respect to the vertical.

10. The apparatus according to claim 9 wherein the weapon-side plotting means comprises:

(a) a means to convert the measured target deviation into values for the actual angle of elevation and lead angle relative to the vertical;

(b) a means for calculating the required angle of elevation and lead angle for the given type of ammunition and the measured target distance;

(c) a means for calculating the difference between the required and actual values for the angle of elevation and the lead angle; and (d) a means for storing this difference.

11. The apparatus according to claim 7 wherein said weapon-side means includes a second memory for storing data of the ammunition type and the ammunition supply, said second memory erased each time the simulation apparatus is switched off, and where the data is inputted into said second memory by means of a special coding device.

12. The apparatus according to claim 11 wherein the data to be stored in said second memory is input by means of laser pulses that are coded with a special input code and are received by the weapon-side receiver.

13. The apparatus according to claim 7 wherein the weapon-side plotting means has a data output for input of the target distance, as determined in the weapon simulation equipment, into the weapon's fire control computer which controls the elevation and azimuth adjustments of the weapon.

14. The apparatus according to claim 7 wherein said control means comprises:

(a) a plurality of cyclecally energized laser transmitting diodes to produce the lateral deflection of the laser pulses; and (b) a deflector lens system for producing the vertical deflection of the laser pulses.

15. The apparatus according to claim 14 wherein said deflector lens system consists of two continuously counter-rotating deflector prisms.

16. The apparatus according to claim 7 wherein a target-side travel speed measurement means consists of a sensor which optically scans a rotating part of the travel gear with a pulse generator.

17. The apparatus according to claim 16 wherein said sensor scans the revolutions of a chain or the tank thread of an armored vehicle.

18. The apparatus according to claim 7 wherein said target-side measurement means determines the travel speed from the vibration spectrum of the vehicle.

19. The apparatus according to claim 7 wherein said target-side meansurement means determines the travel speed by means of an optical correlator.

20. The apparatus according to claims 16, 17, 18 or 19 further including means for the wireless transmission of the measurement results obtained by the target-side measurement means for travel speed by means of coded light or laser pulses, to a sensor provided at the target side.

21. The apparatus according to claim 7 wherein said target is an armored vehicle having an undercarriage and a turret and wherein said target-side measurement means for determining the direction of travel of the target has an optical reference transmitter on the target undercarriage and a plurality of sensors on the turret for optical determination of the turret position relative to the undercarriage.

22. The apparatus according to claim 21 wherein said second sensors are provided around the turret for receiving and determining the direction of the laser pulses as well as the optical reference transmitter, said reference transmitter controlled by the target-side travel speed measurement means for the purpose of pulse coding.

* * * * *